United States Patent [19]

Silvestri, Jr. et al.

[11] Patent Number: 5,018,356

[45] Date of Patent: May 28, 1991

[54] TEMPERATURE CONTROL OF A STEAM TURBINE STEAM TO MINIMIZE THERMAL STRESSES

[75] Inventors: George J. Silvestri, Jr., Winter Park; James A. Martin, Winter Springs; Douglas R. Ulrich, Chuluota, all of Fla.

[73] Assignee: Westinghouse Electric Corp., Pittsburgh, Pa.

[21] Appl. No.: 597,942

[22] Filed: Oct. 10, 1990

[51] Int. Cl.[5] ..... F01K 13/02

[52] U.S. Cl. ..... 60/646; 60/657

[58] Field of Search ..... 60/646, 657

[56] References Cited

U.S. PATENT DOCUMENTS

| | | | |
|---|---|---|---|
| 4,320,625 | 3/1982 | Westphal et al. | 60/646 |
| 4,589,255 | 5/1986 | Martens et al. | 60/646 |
| 4,598,551 | 7/1986 | Dimitroff, Jr. et al. | 60/646 |
| 4,651,533 | 3/1987 | Ura et al. | 60/646 X |
| 4,792,912 | 12/1988 | Kuramoto et al. | 60/646 X |

FOREIGN PATENT DOCUMENTS

| | | |
|---|---|---|
| 52-24604 | 6/1975 | Japan . |
| 59-85403 | 5/1984 | Japan . |
| 642493 | 1/1979 | U.S.S.R. . |

*Primary Examiner*—Allen M. Ostrager

[57] ABSTRACT

A steam turbine system having a steam chest coupled in operating relationship to a steam turbine includes apparatus for controlled heating of the steam chest to reduce thermal stresses. A throttle valve is connected in a steam flow path between a steam source and the steam chest for regulating the flow of steam over a predetermined range of steam flow rates. A temperature sensor is coupled to the steam chest for providing signals indicative of the temperature of the steam chest. A steam leak-off line coupled to the steam chest includes a flow control valve for regulating the flow of steam from the steam chest through the leak-off line, and a controller is coupled in a controlling relationship to the throttle valve and the flow control valve for controlling the flow of steam into and out of the steam chest to effect a controlled warming of the steam chest. The controller is connected to receive the signals from the temperature sensor and is responsive to the signals for controlling warming of the steam chest.

4 Claims, 1 Drawing Sheet

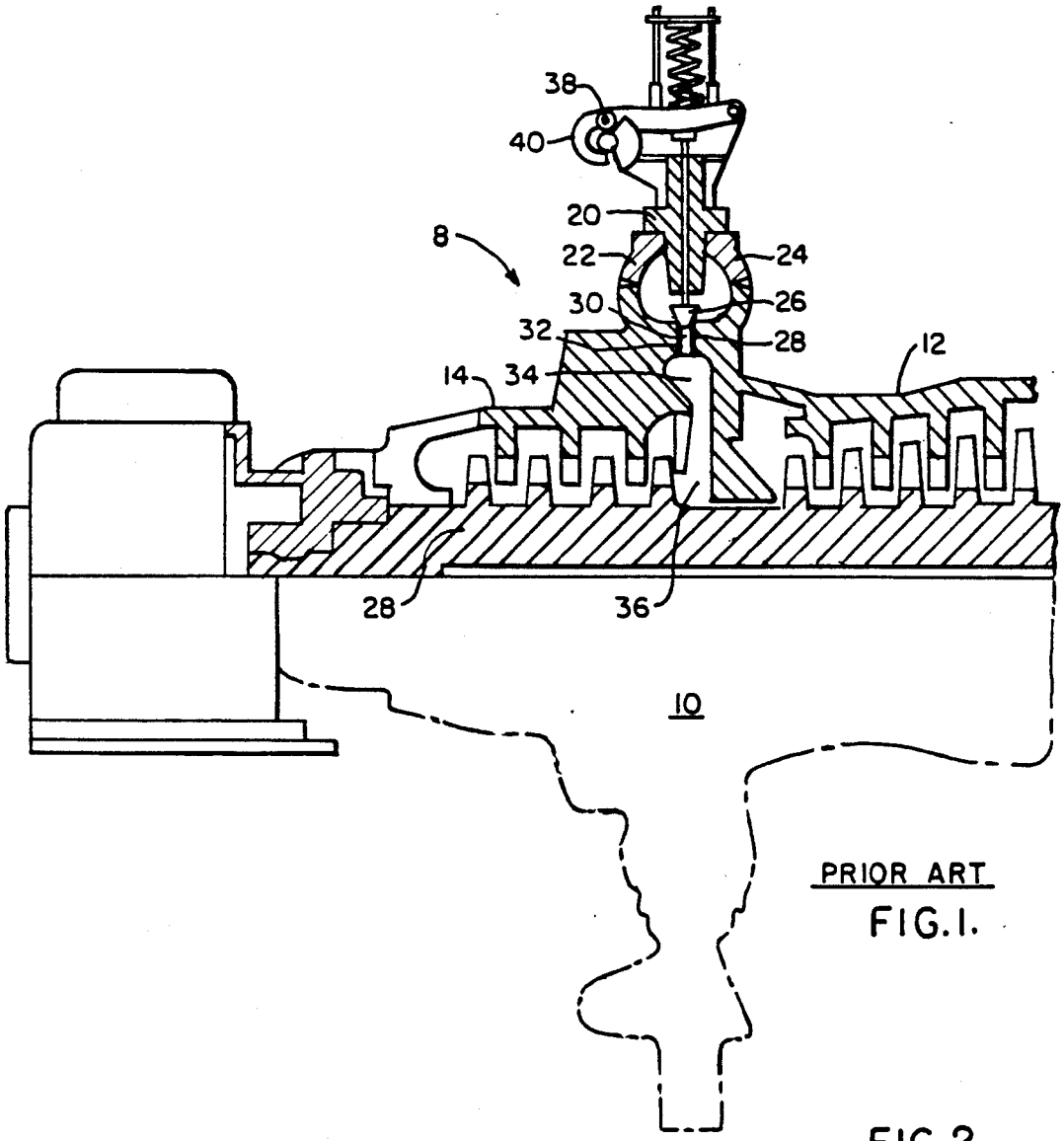
PRIOR ART
FIG. 1.
FIG. 2.
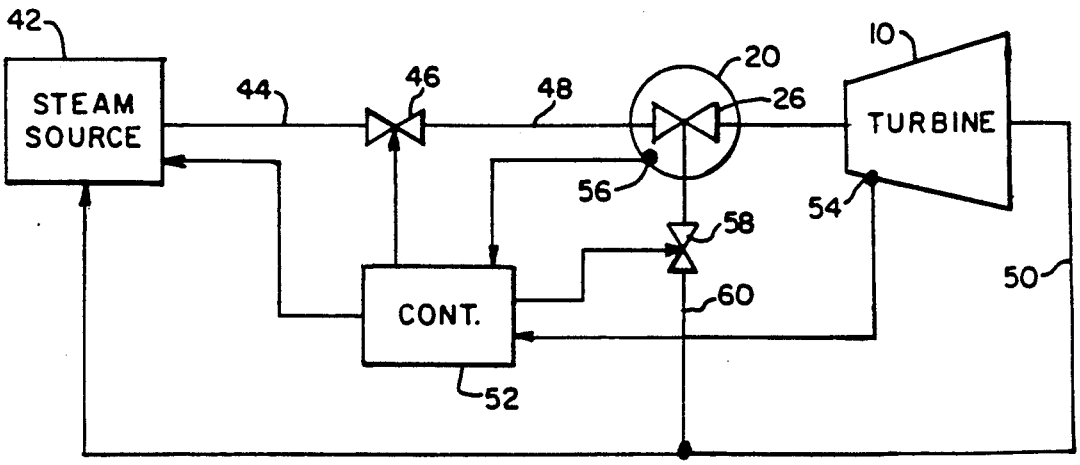

TEMPERATURE CONTROL OF A STEAM TURBINE STEAM TO MINIMIZE THERMAL STRESSES

The present invention relates to cyclically operated steam turbines and, more particularly, to a method and apparatus for controlling the temperature of a steam chest in a steam turbine system in a manner to minimize thermal stresses on the steam chest.

BACKGROUND OF THE INVENTION

A steam turbine for generating utility power includes, inter alia, a steam chest where high pressure steam from a boiler or other steam source is collected and then admitted through apertures controlled by valves into the turbine casing, where its energy is utilized to rotate a power shaft or rotor. The steam chest is preferably located as close to the turbine as possible to minimize heat loss and pressure drops. Efficiency of the turbine increases with increasing temperature and pressure, but high pressures and temperatures involve inherent thermal stress problems that turbine designers must address. Turbine casings must be exceedingly strong to withstand high steam pressures. Turbine parts and ancillary equipment subjected to high temperatures must be free to expand and contract with temperature changes. Walls thick enough to withstand the high pressures involved can experience differential thermal expansion due to temperature gradients, resulting in high thermal stresses of the turbine casing and steam chest. The turbine and integral steam chest are subjected to severe thermal stresses during load cycling and serious cracking has occurred in various parts of the steam chest and steam turbine if care is not taken in the manner in which the steam is introduced into a cold turbine.

In general, the admission of steam to a steam turbine raises a significant problem of matching the temperature of the steam with the temperature of the turbine in order to avoid thermal stresses, particularly in the rotor. Efficiency of utilization of the steam and of the steam turbine requires that matching of such temperatures be achieved promptly in order to minimize the lag between a cold steam input during a restart and a hot turbine rotor, or between a hot steam input and a cold turbine rotor, both processes being necessary to minimize rotor stress in plant start-up time. Various systems have been developed for controlling the admission of steam into a steam turbine in a manner to minimize stresses on the turbine rotor during start-up or during cycling of the rotor between high and low power conditions. U.S. Pat. No. 4,589,255 assigned to the assignee of the present invention addresses the effects of thermal loading on a steam turbine and the risk of rotor thermal stress and plastic strain due to rapid thermal gradients placed upon the turbine.

While it has been recognized that the steam chest is also subjected to significant thermal stresses during cycling of the steam turbine, it is not believed that an adequate solution to minimizing the thermal stress on the steam chest has been developed. Prior art attempts to control steam chest thermal stresses have primarily relied upon intervention by an operator of the steam turbine relying solely on judgment to decide if the differential temperature between steam being introduced into the steam chest and the temperature of the steam chest is such as to avoid failure of the steam chest due to thermal stress. In some instances, such judgment has proven to be faulty. In these prior art systems, it is a general practice to close a set of control valves and modulate a throttle valve to allow some flow of high temperature steam into the steam chest. By controlling the flow into the steam chest, it is intended to produce a control ramp of steam chest metal temperature and thus reduce thermal fatigue. However, it is believed that such a process does not minimize thermal stress on the steam chest and in fact may introduce other thermal stresses on the chest.

SUMMARY OF THE INVENTION

It is an object of the present invention to provide a method and apparatus for controlling the temperature of a steam chest and a steam turbine system in a manner to minimize thermal stresses on the steam chest during start-up or cyclical operation of the turbine.

It is another object of the present invention to provide a method and apparatus for introducing and controlling a flow of steam through a steam chest in such a manner as to control the prewarming cycle of the steam chest in a manner to minimize thermal stress.

In one form, the present invention is illustrated as a method in a steam turbine system for reducing thermal stresses on a steam chest coupled in operating association with the steam turbine, either during start-up operation or during cyclical operation, by regulating a flow of steam through the steam chest. In the illustrated embodiment, the turbine system includes a source of controllable temperature steam such as a boiler, a throttle/stop valve connected between the steam source and the steam chest, and apparatus for regulating the flow of steam to the steam chest over at least a predetermined range of steam flow rates. At least one temperature sensor is positioned in the steam chest for providing signals indicative of temperature of walls of the steam chest. A steam leak-off line is connected to the steam chest and includes a flow control valve for regulating the flow of steam through the leak-off line. A controller is connected to the throttle valve, the flow control valve, and to the temperature sensor for regulating the throttle valve and control valve in response to the temperature sensor in a manner to control the thermal gradients experienced in the steam chest as steam is admitted through the throttle valve and allowed to flow in a continuous manner through the steam chest. In one form, a selected desirable temperature for the walls of the steam chest is predeterminately selected based upon the temperature of steam to be admitted into the steam turbine when turbine operation is desired. The temperature measured by the at least one temperature sensor is compared to the desirable temperature and the throttle valve and control valve adjusted to allow a flow of steam into and through the steam chest in a manner to gradually heat the walls of the steam chest. The throttle valve and flow control valve are continuously controlled in such a manner as to maintain the steam chest temperature within a predetermined range of the desired temperature until turbine operation is reestablished. When the steam chest control valves are opened to admit steam into the steam turbine, the flow control valve in the leak-off line is closed and turbine operation continues in a normal manner.

The control of the temperature of the steam chest may also be utilized in combination with control of the temperature of other components within the steam turbine as is set forth in the aforementioned U.S. Pat. No. 4,589,255. The controller for regulating the steam admittance into the steam chest by controlling the throttle valve and flow control valve in the leak-off line may comprise the adaptive temperature demand controller as set forth and described in the aforementioned U.S. Patent.

BRIEF DESCRIPTION OF THE DRAWINGS

For a better understanding of the present invention, reference may be had to the following detailed description taken in conjunction with the accompanying drawings in which:

FIG. 1 is a partial cross-sectional view of the steam turbine system incorporating an integral steam chest, taken along a longitudinal axis of the system; and FIG. 2 is a simplified functional block diagram of a steam control system in accordance with the present invention.

DETAILED DESCRIPTION OF THE PREFERRED EMBODIMENT

Referring to the drawings and in particular to FIG. 1, there is illustrated a partial cross-sectional view of a steam turbine system 8 including a steam turbine 10 and an integral steam chest 20. Turbine 10 includes a turbine casing 12 having a top wall 14 with integral steam chest 20 having a wall 22 continuous with turbine wall 14. Steam chest wall 22 may be welded to the turbine wall 14 at interface 24. The steam chest 20 includes a plurality of spaced valve members 26 which seal against valve seats 28. Each valve seat 28 leads into an exit port 30 and into a diffuser 32 which directs steam into the turbine nozzle inlet area 34. The steam from the inlet area 34 is directed towards the first stage of turbine blading indicated generally at 36. The valve members 26 are opened and closed by cams 38 rotated by a cam shaft 40.

Turning now to FIG. 2, there is shown a highly simplified schematic representation of a steam turbine system incorporating features of the present invention. A steam source 42 which may be a boiler or other apparatus well known in the art provides a source of control temperature and pressure steam. For purposes of the present invention, the steam from source 42 is supplied via lines 44 to a stop/throttle valve 46. The throttle valve 46 is of a type well known in the art and may include a pilot valve which can be regulated in position to allow a controlled amount of steam to pass through the valve over a predetermined range of steam flow. The pilot valve within the stop/throttle valve 46 is typically used to regulate very small or low rates of steam flow to initially pressurize and preheat the system prior to fully opening the throttle valve. From the throttle valve 46, steam is directed through piping 48 to the steam chest 20. The control valves 26 within steam chest 20 then regulate the flow of steam into the turbine 10. Cooled and condensed steam exits the turbine 10 and is collected in feedwater piping 50 and returned to steam source 42. It will be appreciated that various elements of the system such as a condenser and feedwater pumps have been omitted for purposes of ease of illustration.

As was previously mentioned, a controller 52 which may be similar to the adaptive temperature demand controller illustrated in the aforementioned U.S. Pat. No. 4,589,255 is incorporated in the system in a manner to match the temperature of the body of the turbine with steam temperature as quickly as possible. In this regard, there is provided a temperature sensor 54 connected to the turbine 10 which provides signals to the controller 52 indicative of selected temperatures within the turbine. In the implementation of the present invention, there is also provided at least one temperature sensor 56 coupled to the steam chest 20 and in particular to the steam chest wall 22. The temperature sensor 56 provides signals to the controller 52 indicative of the temperature of the steam chest wall 22.

The controller 52 is coupled to the throttle valve 46 in such a manner that it is capable of regulating steam flow through the valve at least by control of the incorporated pilot valve so as to control the steam flow over at least a predetermined low range of steam flow rates. In addition, the controller 52 is coupled to a flow control valve 58 connected in a leak-off line 60 between the steam chamber 20 and the feedwater reheat line 50. The leak-off line 60 is coupled to the steam chest 20 in order to provide for a continuous flow of steam through the chest 20 while it is being warmed to the temperature of the incoming steam.

The use of the leak-off line 60 and flow control valve 58 is significant to the present invention in that the prior procedure of introducing steam into the steam chest 20 has been found to produce detrimental steam temperature excursions. These excursions are believed to be caused because the energy level of steam under conditions of steady flow is established by the enthalpy, h, which has two components, internal energy U which is a function of temperature and flow or displacement work pv/J where p is the pressure, v is the specific volume, and J is the conversion constant equal to 778.2. When a flow is brought to rest, i.e., changed to a non-flow process, all of the pv/J term relating to flow or displacement work is converted into internal energy U. Since internal energy depends upon temperature, the temperature of the steam will increase. Mathematically, the relationship can be established as:

$$\text{Energy Level} = h_1 = U_1 + p_1 v_1 / J = U_2$$

which implies that the temperature $T_2$ at the non-flow process is greater than the temperature $T_1$ when the steam is flowing.

If there a small amount of leakage flow through the valves 26 of the steam chest 20, or if the flow is intermittent, only a portion of the pv/J term will be converted into internal energy and a lesser increase in steam temperature will occur. This condition can be characterized as a semi-flow process. When the control valve 26 is opened, the steam temperature within the steam chest 20 will drop because the pv/J term will increase and internal energy will decrease. Consequently, the steam chest 20 will experience step changes in steam temperature, an increase when the throttle valve 46 is open and the control valves 26 are closed followed by a decrease when the control valves 26 are opened. Table I illustrates the changes in temperature that occur when there is a change from a flow to a non-flow process in the steam chamber 20.

TABLE I

| $P_1$ kg/sq. cm | $T_1$ °C. | $H_1$ kj/kg | $U_1$ kj/kg | pv/J kj/kg | $U_2$ kj/kg | $T_2$ °C. | $T = T_2 - T_1$ °C. |
|---|---|---|---|---|---|---|---|
| 42.2 | 426.7 | 3275.7 | 2968.7 | 307.0 | 3275.7 | 599.4 | 155.0 |

TABLE I-continued

| $P_1$ kg/sq. cm | $T_1$ °C. | $H_1$ kj/kg | $U_1$ kj/kg | pv/J kj/kg | $U_2$ kj/kg | $T_2$ °C. | $T = T_2 - T_1$ °C. |
|---|---|---|---|---|---|---|---|
| 42.2 | 482.2 | 3402.9 | 3067.1 | 335.9 | 3402.9 | 669.4 | 169.4 |
| 70.3 | 426.7 | 3232.2 | 2936.3 | 295.9 | 3232.2 | 585.0 | 140.6 |
| 70.3 | 482.2 | 3369.2 | 3041.9 | 327.3 | 3369.2 | 658.9 | 158.9 |

The leak-off line 60 on the steam chest 20 dumps to the cold reheat line 50 and thus provides a means for maintaining flow through the steam chest 20. However, it will be appreciated that the line 50 merely represents an available low pressure zone, i.e., while the leak-off line is illustrated as dumping to a cold reheat line on a reheat turbine, it could as well be dumped to a HP exhaust on a two shell turbine or to any other available low pressure zone. The leak-off line 60 is provided with a control valve. 58 which allows the pressure inside the steam chest 20 to be controlled. This control in turn allows better control of the temperature of the steam trapped within the steam chest 20 and thus avoids the steam temperature excursions previously mentioned. Table II illustrates the effect of pressure on steam chest steam temperature for a given throttle valve condition when steam is throttled by valve 46. In the Table, $P_{TH}$ and $T_{TH}$ represent throttle valve pressure and temperature, respectively. The terms $P_{SC}$ and $T_{SC}$ represent, respectively, the pressure and temperature within the steam chest 20. As can be seen from Table II, the method and apparatus described above and as shown in FIG. 2 eliminates the temperature excursions and also provides a measure of control on steam temperatures within the steam chest 20 by controlling the steam chest pressure.

TABLE II

| $P_{th}$ kg/sq. cm | $T_{th}$ °C. | $h_{th}$ kj/kg | $P_{SC}$ kg/sq. cm | $T_{SC}$ °C. |
|---|---|---|---|---|
| 42.2 | 426.7 | 3461.8 | 21.1 | 412.8 |
| 42.2 | 426.7 | 3275.7 | 7.0 | 403.3 |
| 42.2 | 482.2 | 3402.9 | 21.1 | 471.1 |
| 42.2 | 482.2 | 3402.9 | 7.0 | 463.3 |
| 70.3 | 426.7 | 3232.2 | 21.1 | 392.8 |
| 70.3 | 426.7 | 3232.2 | 7.0 | 382.2 |
| 70.3 | 482.2 | 3369.2 | 21.1 | 455.6 |
| 70.3 | 482.2 | 3369.2 | 7.0 | 447.2 |
| 105.5 | 426.7 | 3172.7 | 21.1 | 366.1 |
| 105.5 | 426.7 | 3172.7 | 7.0 | 353.9 |
| 105.5 | 482.2 | 3324.3 | 21.1 | 435.0 |
| 105.5 | 482.2 | 3324.3 | 7.0 | 426.1 |
| 140.6 | 426.7 | 3106.1 | 21.1 | 336.1 |
| 140.6 | 426.7 | 3106.1 | 7.0 | 322.2 |
| 140.6 | 482.2 | 3276.6 | 21.1 | 413.3 |
| 140.6 | 482.2 | 3276.6 | 7.0 | 403.3 |

While the invention has been described in what is presently considered to be a preferred embodiment, various modifications and additions will become apparent to those skilled in the art. It is intended therefore that the invention not be limited to the illustrated embodiment but be interpreted within the full spirit and scope of the appended claims.

What is claimed is:

1. A method in a steam turbine system for reducing thermal stresses in a steam chest coupled in operating association with a steam turbine subjected to cyclic operation, the system including a source of controllable temperature steam, a throttle valve connected between the steam source and the steam chest and including means for regulating the flow of steam to the steam chest over at least a predetermined range of flow rates, at least one temperature sensor coupled to the steam chest for providing signals indicative of temperature of walls of the steam chest, a steam leak-off line connected to the steam chest and including a flow control valve for regulating the flow of steam through the leak-off line, and control means connected to the throttle valve and the flow control valve and further connected to the temperature sensor, the method comprising the steps of:

selecting a desirable temperature for the walls of the steam chest predeterminately related to the temperature of the steam to be admitted into the steam turbine;

comparing in the control means the desirable temperature of the steam chest walls to the temperature indicated by the at least one temperature sensor; and controlling the throttle valve and flow control valve to establish a steam flow through the steam chest sufficient to effect a warming of the steam chest walls at a preselected low rate to minimize thermal stress on the steam chest from heating until the steam chest wall temperature is within a preselected range of the desirable temperature.

2. The method of claim 1 and including a steam reheat system coupled to the steam turbine, the method including the further step of coupling the steam from the leak-off line to the reheat system.

3. The method of claim 1 and further including the step of closing the flow control valve during turbine operation.

4. A steam turbine system having a steam chest coupled in operating relationship to a steam turbine and including apparatus for controlled heating of the steam chest to reduce thermal stresses comprising a source of controllable temperature steam, a throttle valve connected in a steam flow path between the steam source and the steam chest for regulating the flow of steam over at least a predetermined range of steam flow rates, at least one temperature sensor coupled to the steam chest for providing signals indicative of the temperature of the steam chest, a steam leak-off line coupled to the steam chest and including a flow control valve for regulating the flow of steam from the steam chest through the leak-off line, and control means coupled in a controlling relationship to the throttle valve and the flow control valve for controlling the flow of steam into and out of the steam chest to effect a controlled warming of the steam chest, the control means being connected to receive the signals from the at least one temperature sensor and being responsive to the signals for controlling warming of the steam chest.

* * * * *